US007645414B2

(12) United States Patent
Gregory et al.

(10) Patent No.: US 7,645,414 B2
(45) Date of Patent: Jan. 12, 2010

(54) TAMPER-INDICATING CLOSURE, CONTAINER, PACKAGE, AND METHODS OF MANUFACTURE

(75) Inventors: James L. Gregory, Maumee, OH (US); Stephanie L. Kurtz-Rooney, Delta, OH (US); David P. Piccioli, Auburn, NH (US); Suppayan M. Krishnakumar, Nashua, NH (US); Q. Peter Zhang, Bedford, NH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 179 days.

(21) Appl. No.: 11/726,541

(22) Filed: Mar. 22, 2007

(65) Prior Publication Data

US 2007/0181525 A1 Aug. 9, 2007

Related U.S. Application Data

(62) Division of application No. 10/690,361, filed on Oct. 21, 2003, now Pat. No. 7,235,207, which is a division of application No. 09/996,190, filed on Nov. 18, 2001, now Pat. No. 6,659,297.

(51) Int. Cl.
*B29C 65/00* (2006.01)
*B65D 41/34* (2006.01)

(52) U.S. Cl. ..... 264/320; 215/252

(58) Field of Classification Search ..... 215/41, 215/24, 200, 202, 216, 217, 218, 250, 252, 215/258; 264/523, 524, 525, 531, 320, 319, 264/299, 239; 53/285, 287, 300, 370
See application file for complete search history.

(56) References Cited

U.S. PATENT DOCUMENTS 3,904,061 A * 9/1975 Keeler ..... 215/252

(Continued)

FOREIGN PATENT DOCUMENTS

DE 3123902 A1 * 6/1982

(Continued)

*Primary Examiner*—Joseph S. Del Sole
*Assistant Examiner*—John P Robitaille
(74) *Attorney, Agent, or Firm*—Reising Ethington PC

(57) ABSTRACT

A tamper-indicating closure for a beverage package includes a base wall having a peripheral skirt with at least one internal thread for securing the closure to a container. A tamper-indicating band is frangibly connected to an edge of the skirt, and a stop flange extends axially and radially from an edge of the band for abutment with a stop bead on the container finish. A plurality of circumferentially spaced drain openings extend axially through the juncture of the band and the flange. A plurality of circumferentially spaced channels extend axially through the internal thread on the closure skirt, with at least some of the channels being axially aligned with the drain openings. The stop bead on the container is in the form of a plurality of circumferentially spaced bead segments separated from each other by circumferential gaps. Liquid product may readily drain from between the container finish and the closure skirt through the axial channels in the closure thread, through the drain openings at the juncture of the closure flange and band, and through the gaps between the stop bead segments on the container finish. The container finish may also have a support flange with drain channels or slots aligned with the gaps in the bead.

20 Claims, 7 Drawing Sheets

U.S. PATENT DOCUMENTS

| | | | | | |
|---|---|---|---|---|---|
| 4,007,848 | A | | 2/1977 | Snyder | |
| 4,369,889 | A | | 1/1983 | Ostrowsky | |
| 4,530,438 | A | | 7/1985 | Mc Devitt | |
| 4,756,438 | A | | 7/1988 | Ryder | |
| 4,884,706 | A | | 12/1989 | Julian | |
| 4,936,475 | A | | 6/1990 | Montgomery | |
| 5,040,692 | A | | 8/1991 | Julian | |
| 5,056,675 | A | | 10/1991 | Julian | |
| 5,137,163 | A | | 8/1992 | Moore | |
| 5,242,068 | A | | 9/1993 | McCandless | |
| 5,346,082 | A | | 9/1994 | Ochs et al. | |
| 5,423,444 | A | | 6/1995 | Druitt | |
| 5,462,186 | A | * | 10/1995 | Ladina et al. | 215/330 |
| 5,462,187 | A | | 10/1995 | Gregory et al. | |
| 5,501,349 | A | * | 3/1996 | McCandless | 215/252 |
| 5,638,972 | A | | 6/1997 | Druitt | |
| 5,676,269 | A | | 10/1997 | Blake et al. | |
| 5,680,945 | A | | 10/1997 | Sander et al. | |
| 5,836,464 | A | | 11/1998 | Druitt | |
| 5,947,311 | A | | 9/1999 | Gregory | |
| 6,053,344 | A | | 4/2000 | Gregory et al. | |
| 6,082,569 | A | | 7/2000 | Druitt | |
| 6,089,390 | A | | 7/2000 | Druitt | |
| 6,119,883 | A | | 9/2000 | Hock et al. | |
| 6,123,212 | A | | 9/2000 | Russell et al. | |
| 6,152,316 | A | | 11/2000 | Niese | |
| 6,224,802 | B1 | | 5/2001 | Gregory et al. | |
| 6,253,940 | B1 | | 7/2001 | Graham et al. | |
| 6,276,543 | B1 | | 8/2001 | German et al. | |
| 6,325,225 | B1 | | 12/2001 | Druitt et al. | |
| 6,705,479 | B2 | | 3/2004 | Druitt et al. | |

FOREIGN PATENT DOCUMENTS

| | | | |
|---|---|---|---|
| EP | 0869067 | A1 | 10/1998 |
| EP | 1048585 | A2 | 11/2000 |
| GB | 2275047 | A | 8/1994 |
| JP | 404339773 | A | 11/1992 |
| JP | 10-152156 | | 6/1998 |

* cited by examiner

TAMPER-INDICATING CLOSURE, CONTAINER, PACKAGE, AND METHODS OF MANUFACTURE

This application is a division of application Ser. No. 10/690,361 filed Oct. 21, 2003 now U.S. Pat. No. 7,235,207, which is a division of application Ser. No. 09/996,190 filed Nov. 18, 2001 and now U.S. Pat. No. 6,659,297.

The present invention is directed to beverage packages, and more particularly to closures and containers for such packages, and to methods of manufacturing such closures and containers. Preferred aspects of the invention relate to improved drainage of product from between the container finish and the closure skirt after filling and capping the container.

BACKGROUND AND OBJECTS OF THE INVENTION

It is conventional to form a tamper-indicating closure having a band connected to a skirt by integral frangible means, such as frangible bridges or a frangible web. The band has a stop element (e.g., a flange or a bead) that engages a bead on the container finish to resist unthreading of the closure, so that removal of the closure ruptures the frangible means that connect the band to the skirt. U.S. Pat. Re33,265, U.S. Pat. Nos. 4,322,009 and 4,432,461, assigned to an assignee of the present application, disclose tamper-indicating closures of this character, in which the tamper-indicating band is completely severed from the closure skirt and remains on the container upon removal of the closure from the container. U.S. Pat. Nos. 5,295,600 and 6,224,802, also assigned to an assignee of the present application, disclose tamper-indicating closures in which the tamper-indicating band remains connected to the closure skirt and is removed from the container with the closure.

Although tamper-indicating closures and packages of the types disclosed in the noted patents have enjoyed substantial commercial acceptance and success, further improvements remain desirable. For example, problems are encountered when employing this type of closure in so-called wet finish applications, in which liquid may spill during or after the filling operation onto the outside surface of the container so as to be disposed between the container finish and the closure skirt after capping. Wet finish situations of this type are encountered during, for example, hot-fill, cold-fill and aseptic-fill situations, in which the containers are filled close to the brim or to overflow prior to capping. Wet finish situations can also be encountered during filling operations in which liquid may drip from the filling machinery onto the container finish. In wet finish situations of this type, problems are encountered in connection with draining and drying of the area between the outside surface of the container finish and the inside of the closure skirt—i.e., between the threads on the container finish and skirt, and around the tamper-indicating band and the stop element. Liquid trapped within this area can result in growth of mold or mildew, and when dry undesirably increases the torque required for removal of the closure from the container.

U.S. Pat. Nos. 6,119,883 and 6,152,316, assigned to an assignee of the present application, disclose tamper-indicating closures in which drain openings are provided at the juncture of the tamper-indicating band and the stop flange—i.e., through the stop flange adjacent to the band, through the band adjacent to the stop flange, or through the hinge portion in both the stop flange and the tamper-indicating band. A plurality of these drain openings, disposed in a circumferentially spaced array around the closure, improve product drainage in the area of the tamper-indicating band and the stop flange. U.S. Pat. No. 6,253,940, assigned to an assignee of the present application, illustrates a closure having drain openings at the juncture of the stop flange and the band, and openings in a flared portion of the closure skirt for admitting flushing solution. This helps flush liquid from between the container finish and the closure in the area of the stop flange and the tamper-indicating band.

It is a general object of the present invention to provide a closure and/or a container and/or a closure and container package that is/are specifically constructed to improve liquid product drainage from between the container finish and the closure in wet finish and other similar situations. Another and related object of the invention is to provide a method of manufacturing such a closure and/or container.

SUMMARY OF THE INVENTION

The present invention involves a number of aspects that may be implemented from, or more preferably in combination with each other.

In accordance with a first aspect of the present invention, a tamper-indicating closure of integrally molded plastic construction includes a base wall having a peripheral skirt with at least one internal thread for securing the closure a container, a tamper-indicating band frangibly connected to an edge of the skirt, a stop element extending axially and radially from the band remote from the skirt, a plurality of circumferentially spaced drain openings extending through the band and/or the stop element, and a plurality of circumferentially spaced channels or grooves extending axially through the internal thread within the closure skirt. At least some of these channels or grooves are axially aligned with drain openings at the hinge portion of the stop flange to promote drainage of liquid through the channels and through the drain openings. The drain openings are preferably uniformly circumferentially spaced around the closure, while the channels or grooves through the internal thread are preferably non-uniformly spaced and clustered at the lead-in of the thread. The preferred embodiments of the invention include double threads having diametrically opposed lead-ins, with the axial channels or grooves being clustered at lesser spacing from each other adjacent to the thread lead-ins.

A beverage container in accordance with another aspect of the invention includes a cylindrical finish having an open mouth, at least one external thread for securing a closure to the finish, an external circumferential stop bead on a side of the thread remote from the container mouth, and an external support flange on a side of the bead remote from the mouth. The stop bead includes a plurality of circumferentially spaced bead segments that are separated from each other by circumferential gaps. A plurality of circumferentially spaced drain elements on the support flange are each axially aligned with a corresponding gap in the stop bead. Fluid may thus freely drain along the external surface of the container finish through the gaps in the stop bead and the drain elements on the support flange. The drain elements on the support flange in one preferred embodiment in accordance with this aspect of the invention take the form of drain grooves on a surface of the support flange axially facing the stop bead. Each groove has a bottom surface that is angulated radially outwardly and axially downwardly away from the bead. The drain elements in accordance with another embodiment of this aspect of the invention comprise drain slots that extend axially through the support flange. The finish preferably has an outer circumferential wall surface, with the external thread, the external bead and the external support flange extending radially outwardly from this wall surface. The gaps in the stop bead and the slots through the support flange are formed by corresponding portions of the wall surface. Thus, fluid may readily flow through these gaps and slots. In the preferred embodiments of the invention, the container is of integrally molded plastic construction, although this aspect of the invention may also readily be implemented in containers of glass construction, for example.

A container and closure package in accordance with another aspect of the invention includes a container having a finish with at least one external thread and an external bead disposed beneath the thread. The closure includes a base wall having a peripheral skirt with at least one internal thread for securing the closure to the external thread on the container finish, a tamper-indicating band frangibly connected to an edge of the skirt, and a stop element extending from the band for abutment with the bead on the container finish. Drain openings are provided in the stop element and/or the band. A plurality of circumferentially spaced axial channels or grooves extend along the inside of the skirt through the internal thread, at least some of which are in axial alignment with drain openings.

A closure and container package in accordance with a further aspect of the invention includes a container having a finish with at least one external thread, an external circumferential bead defined by a plurality of circumferentially spaced bead segments separated from each other by circumferential gaps, an external flange on a side of the bead remote from the thread, and a plurality of circumferentially spaced drain elements on the flange and each axially aligned with a corresponding gap in the bead. The closure includes a base wall having a peripheral skirt and at least one internal thread for affixing the closure to the external thread on the container finish. A tamper-indicating band is frangibly connected to the skirt, and a stop element extends from the band for abutment with the bead on the container finish. Drain openings may be provided, but need not necessarily be provided in accordance with this aspect of the invention, in the stop element and/or the tamper-indicating band.

In accordance with yet another aspect of the present invention, a method of making a tamper-indicating closure contemplates integrally molding the closure of plastic as-molded construction that includes a base wall having a peripheral skirt with at least one internal thread for affixing the closure to a container, a tamper-indicating band frangibly connected to an edge of the skirt, a stop element extending from the band, and a plurality of circumferentially spaced drain openings extending through the band adjacent to the stop element, through the stop element adjacent to the band, or through both the element and the band. The step of molding the closure is such that a plurality of circumferentially spaced channels or grooves are formed extending axially through the internal thread, with at least some of the grooves being axially aligned with drain openings in the stop element and/or band.

A method of making a beverage container in accordance with a further aspect of the present invention includes integrally molding a container having a cylindrical finish with an open mouth, at least one external thread, an external circumferential bead on a side of the thread remote from the mouth and an external circumferential flange on a side of the bead remote from the thread. The step of molding the container is such that the bead comprises a plurality of circumferentially spaced bead segments separated from each other by circumferential gaps, and the flange includes a plurality of circumferentially spaced drain elements each axially aligned with a corresponding gap in the bead. These drain elements preferably include drain grooves or slots in the external flange. The bead segments are preferably of uniform circumferential dimension and at uniform circumferential spacing. The container is preferably of molded plastic construction, although this aspect of the invention may also be implemented in glass containers, for example.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
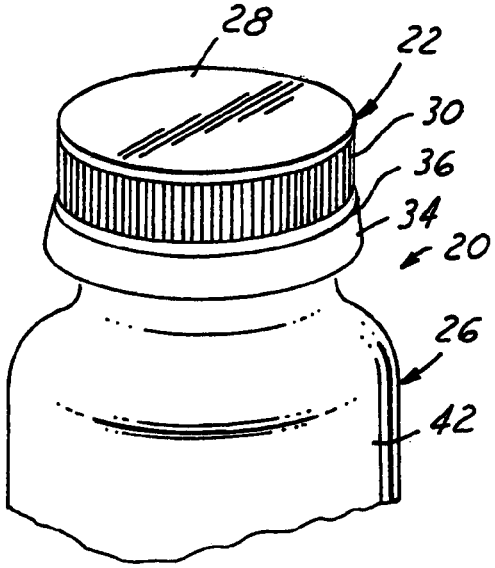
FIG. 1 is a fragmentary perspective view of a closure and container package in accordance with one presently preferred embodiment of the invention.
Figure 2:
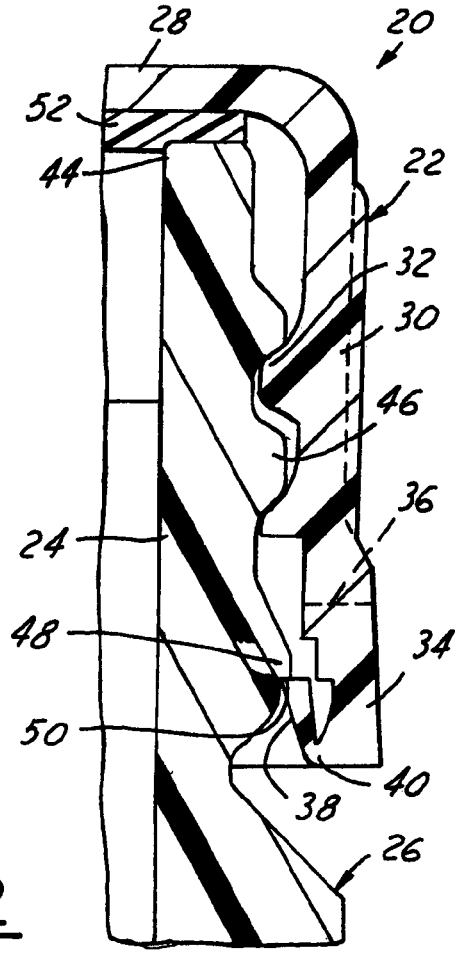
FIG. 2 is a fragmentary sectional that illustrates the container finish and closure in the package of FIG. 1.
Figure 3:
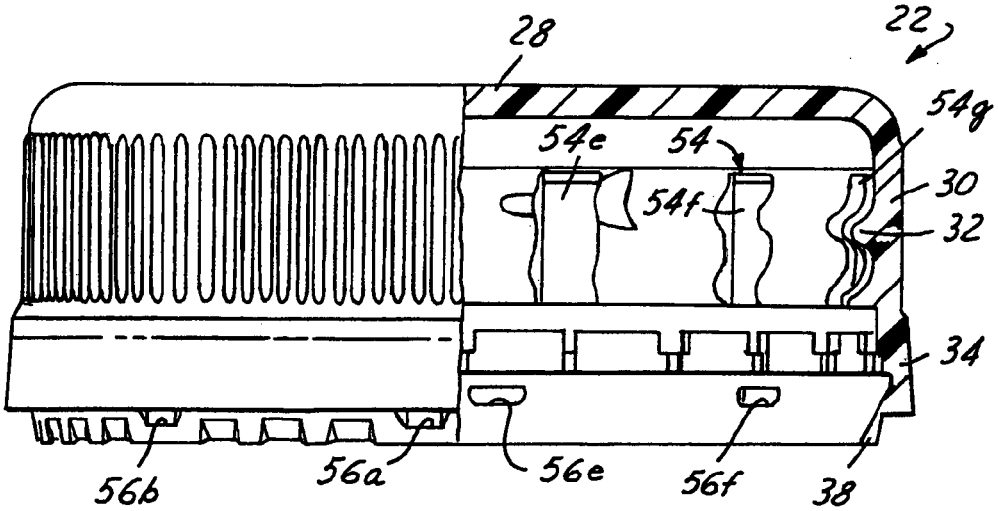
FIG. 3 is a partially sectioned side elevational view of the closure in the package of FIGS. 1 and 2 as molded—i.e., before stop flange inversion.

FIGS. 1 and 2 illustrate a closure and container package 20 in accordance with one presently preferred embodiment of the invention as comprising a closure 22 secured to the finish 24 of a container 26. Closure 22 includes a base wall 28 from which a peripheral skirt 30 extends. At least one internal thread 32 extends around the inside surface of closure skirt 30. A tamper-indicating band 34 is connected by frangible means 36 to the free edge of skirt 30 remote from base wall 28. Frangible means 36 may comprise frangible bridges or a frangible membrane in the closure as molded and/or scored into the closure after molding. A stop flange 38 extends axially and radially from the lower edge of tamper-indicating band 34, being connected thereto by a hinge portion 40. (Directional words such as "axially" and "radially" are employed for purposes of description and not limitation, and are taken with respect to the central axis of the closure when a closure is being discussed or the central axis of the container finish when the container finish is being discussed. Directional words such as "upward" and "downward" are taken with respect to the upright orientation of the package and components illustrated in the drawings.) Container 26 includes a body 42 for containing a beverage product and from which cylindrical finish 24 extends. Finish 24 has an open mouth 44, at least one external thread 46 engaged by internal thread 32 on closure skirt 30 to secure closure 22 to container 26, and a radially outwardly extending external stop bead 48 on the opposite side of thread 46 from mouth 44. Bead 48 has an axially facing shoulder 50 that is engaged by an opposing end of flange 38 when closure 22 is in position on container 26. Abutment of flange 38 against bead 48 causes rupture of frangible means 36 as closure 22 is unthreaded from container finish 28 so that band 34 indicates tampering with the closure. A liner 52 may be secured or otherwise disposed on the inner surface of closure base wall 28 for sealing engagement with the upper edge of finish 24 to seal the contents of the container. Alternatively, but less preferably, the closure may be a linerless closure with sealing means of conventional type.

Figure 4:
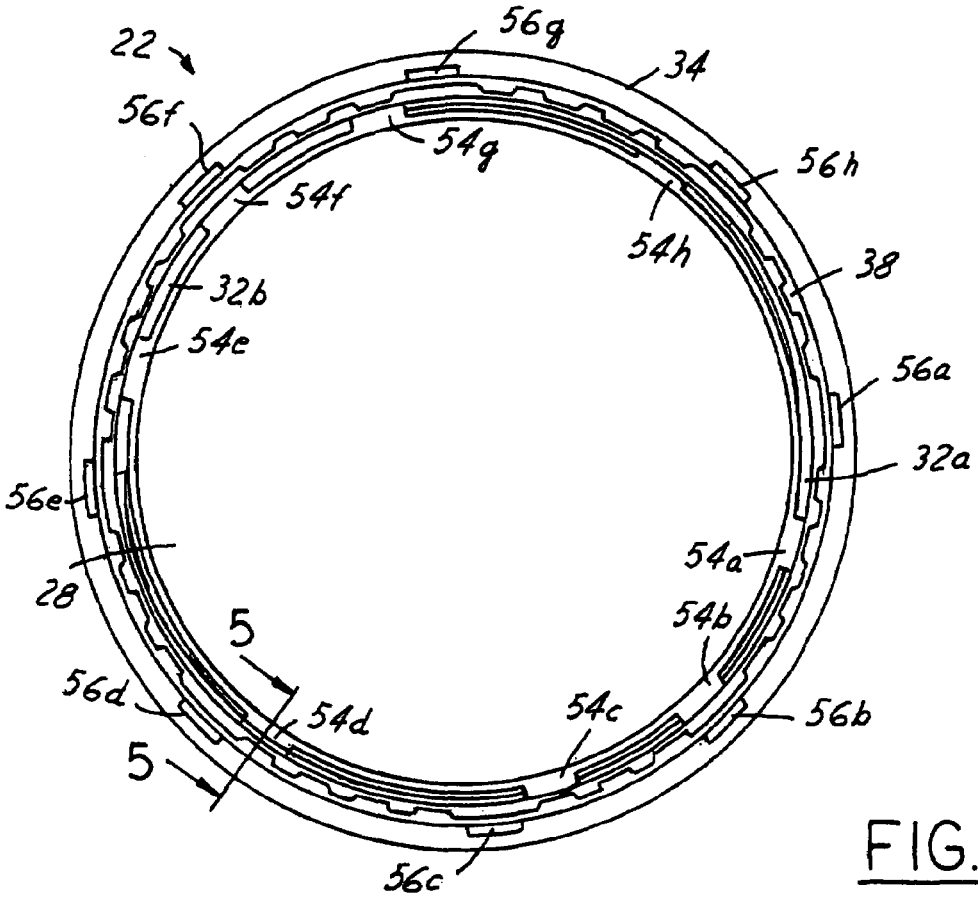
FIG. 4 is a bottom plan view of the closure illustrated in FIG. 3.
Figure 5:
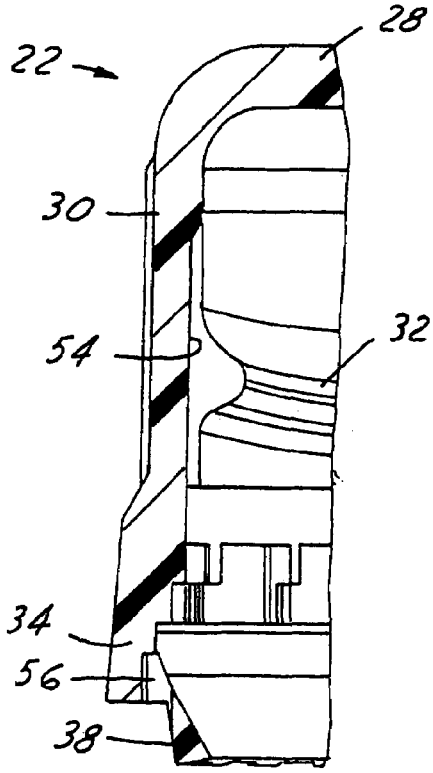
FIG. 5 is a fragmentary sectional view taken substantially along the line 5-5 in FIG. 4.
Figure 6:
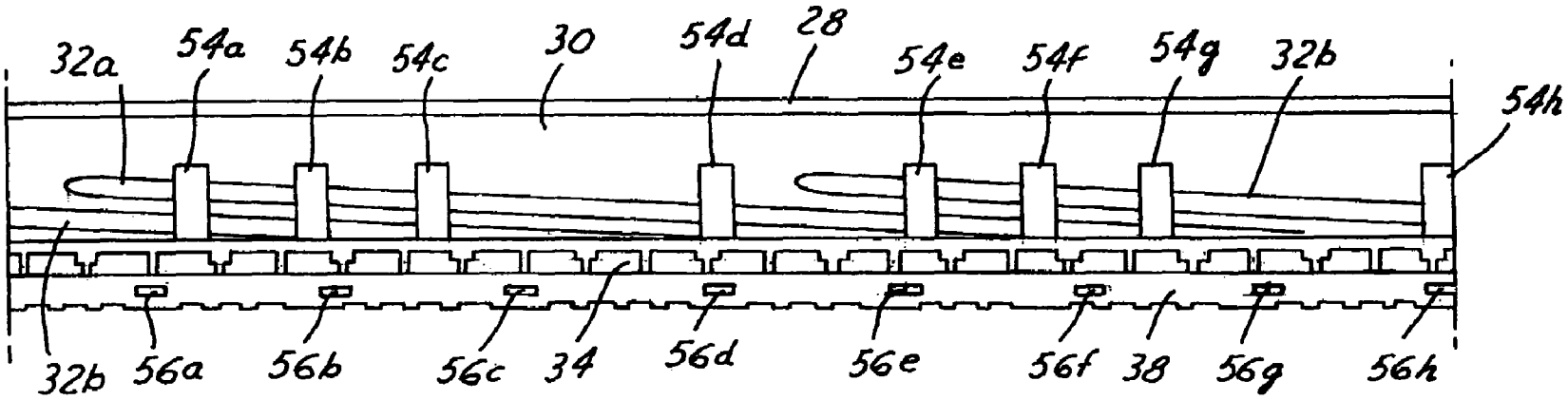
FIG. 6 is a developed elevational view of the inside circumference of the closure illustrated in FIGS. 3-5.

Closure 22 is illustrated in greater detail in FIGS. 3-6. A plurality of channels or grooves 54 extend axially along the inside surface of closure skirt 30 through internal thread 32. More specifically, and as best seen in FIGS. 4 and 6, thread 32 comprises a double thread 32*a*, 32*b* each having an associated lead-in disposed adjacent to base wall 28. In the illustrated embodiment, there are eight circumferentially spaced channels 54*a*-54*h* extending through threads 32*a*, 32*b*, with the circumferential spacing between and among the channels being non-uniform around the inside surface of the closure skirt. Channels 54*a*, 54*b*, 54*c* are clustered adjacent to the lead-in of thread 32*a*, while channels 54*e*, 54*f*, 54*g* are clustered adjacent to the lead-in of thread 32*b*. Channels 54*d* and 54*h* are spaced from the thread lead-ins, and are at greater circumferential spacing from channel groups 54*a*-54*c* and 54*e*-54*g* than the channel spacing within the respective groups. In a 43 mm embodiment of closure 22, channel 54*a* is 15° from full start of thread 32*a*, channel 54*b* is 30° from channel 54*a*, and channel 54*c* is 30° from channel 54*b*. Channel 54*d* is at 50° spacing from channel 54*c*, and channel 54*e* is at 70° spacing from 54*d*. Channels 54*e*, 54*f*, 54*g* and 54*b* are diametrically opposite channels 54*a*, 54*b*, 54*c*, and 54*d* respectively. As best seen in FIG. 5, each channel 54 is slightly indented into the inside surface of closure sidewall 30. In the illustrated 43 mm embodiment of the invention, this indentation is in the range of 0.012 to 0.014 inches, and channels 54 each have a tangential dimension of 0.125±0.007 inch.

A circumferential array of axial drain openings 56 are formed at the juncture of stop flange 38 and tamper-indicating band 34, either entirely within the stop flange, entirely within the band, or partially within both the flange and the band as illustrated in the drawings. As best seen in FIGS. 4 and 6, there are eight drain openings 56*a*-56*h* in the illustrated embodiment of the invention at uniform 45° spacing from each other. Channels 54*b*, 54*d*, 54*f* and 54*h* are axially aligned with corresponding drain openings 56*b*, 56*d*, 56*f* and 56*h*. The remaining channels and drain openings are not axially aligned in the illustrated embodiment of the invention. Channels 54*a*, 54*b*, 54*c* and channels 54*e*, 54*f*, 54*g* are clustered in the areas of dual-thread overlap because of the need for enhanced drainage in this area. In a single-thread closure, channels 54*a*-54*h* can be uniformly spaced around the closure and all axially aligned with associated drain openings 56*a*-56*h*. Drain openings 56 in the illustrated embodiment of the invention have a radial dimension of 0.030 and a tangential dimension of 0.125±0.007 inch. Closure 22 is preferably of integrally molded plastic construction such as polypropylene. Channels 54 and drain openings 56 are molded into the closure, and frangible means 36 is either molded into the closure or scored into the closure in an after-molding operation.

After filling of container 26 with a beverage, closure 22 is applied to the container finish in a conventional capping operation. Any liquid product disposed on the external surface of the container finish can drain through channels 54 that extend through the closure internal thread(s). In this connection, recessing of the channels into the closure skirt, as illustrated in FIG. 5, promotes drainage of the liquid past the external thread(s) on the container finish. The liquid may then drain downwardly between flange 38 and band 34, and thence through drain openings 56. In this connection, it will be appreciated that alignment of channels 54*b*, 54*d*, 54*f* and 54*h* with corresponding drain openings 56*b*, 56*d*, 56*f* and 56*h* helps promote this liquid drainage.

Figure 10:
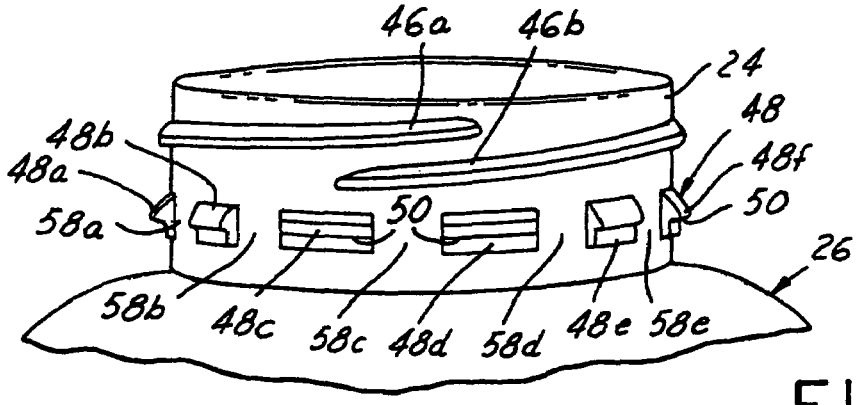
FIG. 10 is a fragmentary perspective view of the container finish in the package of FIGS. 1 and 2.

FIG. 10 illustrates container finish 24 in accordance with another aspect of the invention. Finish bead 48 is not circumferentially continuous in FIG. 10, but rather comprises a plurality of external bead segments 48*a*-48*f*. These bead segments are circumferentially spaced from each other by gaps, such as gaps 58*b*, 58*c*, 58*d* in FIG. 10. In this embodiment, finish 24 has a generally cylindrical outer surface from which dual external thread 46*a*, 46*b* and segmented external bead 48*a*-48*f* radially extend. Gaps 58*b*-58*d* are continuations of the outer finish wall surface between the bead segments. Thus, in this embodiment, fluid that flows from between the finish outer surface and the skirt inner surface, such as through channels 54 on the skirt inner surface and/or corresponding channels on the finish outer surface, can flow through the gaps or spaces 58*b*-58*d* between segments of bead 48. This finish configuration greatly facilitates fluid drainage. Exemplary dimension for bead segments 48*a*, etc. and gaps 58*b*, etc., for an exemplary 48 mm embodiment of the invention, are given in connection with FIGS. 11-15. A container embodying the segmented stop bead configuration of FIG. 10 is preferably of molded plastic construction such as PET. Alternatively, this aspect of the invention can be implemented in otherwise conventional glass containers.

Figure 9:
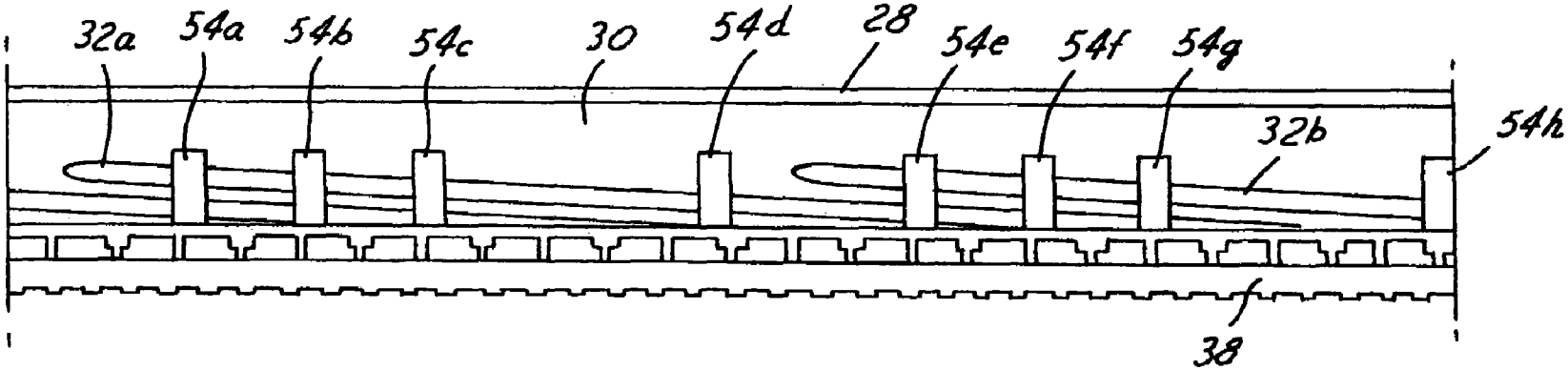
FIG. 9 is a developed elevational view of the inside circumference of the closure in FIGS. 7 and 8.
Figure 7:
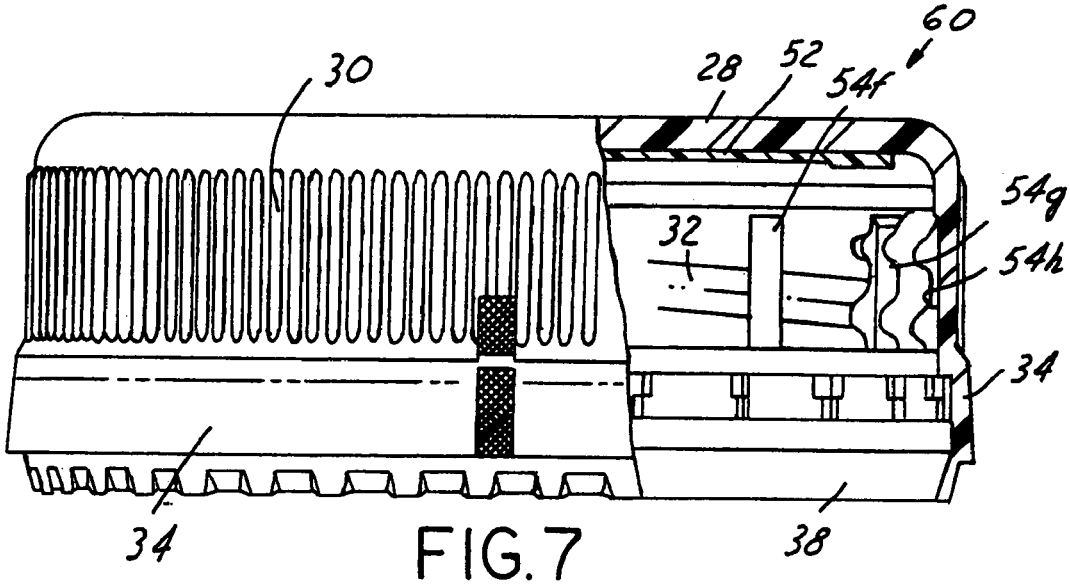
FIG. 7 is a partially sectioned elevational view similar to that of FIG. 3 but showing a closure in accordance with a modified embodiment of the invention.
Figure 8:
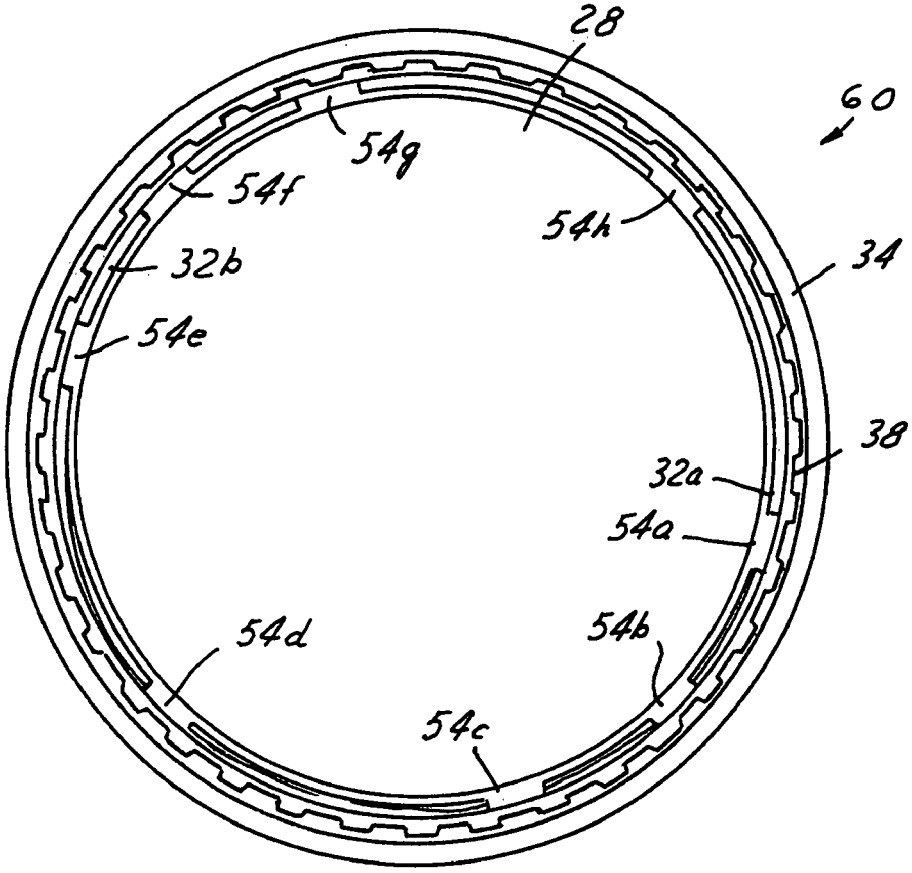
FIG. 8 is a bottom plan view of the closure illustrated in FIG. 7.

FIGS. 7-9 illustrate a closure 60 in accordance with a modified embodiment of the invention. In FIGS. 7-9 (and 10-16), elements identical or similar to those in FIGS. 2-6 are indicated by correspondingly identical reference numerals. The primary difference between closure 60 in FIGS. 7-9 and closure 22 in FIGS. 2-6 is that no drain openings 56 are provided in stop flange 38 and/or band 34. Thus, closure 60 of FIGS. 7-9 is particularly well suited for use in conjunction with the container finish illustrated in FIG. 10, in which drain passages are provided between segments of the finish bead.

FIGS. 11-15 illustrate a container 70 in accordance with one embodiment of another aspect of the invention. Container 70 includes a body for holding a beverage, and a cylindrical container finish 74. Finish 74 includes a pair of external threads 46*a*, 46*b* for securing a closure to the container finish, an external stop bead 48, also known as an A bead, and an external support flange 82 also known as a support ledge or capping flange. Container finish 74, including support flange 82, is typical of injection blow molded containers. Stop bead 48 comprises a plurality of circumferentially spaced bead segments 48*a* through 48*j*, which are spaced from each other by inter-segment gaps 58*a*-58*j*. Bead 48, defined by bead segments 48*a*-48*j* and intervening slots or gaps 58*a*-58*j*, is disposed in a plane perpendicular to the finish axis on a side of threads 48*a*, 48*b* remote from the container mouth, and function in cooperation with a stop bead or a stop flange on a closure to provide the tamper-indicating function previously described. Support flange 82 is circumferentially continuous in the embodiment of FIGS. 11-13 in a plane parallel to bead 48, and has an upper surface facing in the direction of bead 48. The upper surface of flange 82 has a plurality of circumferentially spaced drain channels or grooves 82*a* through 82*j*. The number of drain grooves 82*a*-82*j* is preferably identical to the number of slots 58*a*-58*j* in bead 48, and each flange groove 82*a*-82*j* is axially aligned with a corresponding bead slot 58*a*-58*j*. Each groove 82*a*-82*j* has a bottom surface at an axially downward and radially outward angle with respect to the container finish axis to promote drainage of liquid from the grooves. Thus, any liquid on the external surface of finish 74 can readily drain through bead slots 58*a*-58*j* and correspondingly aligned flange grooves 82*a*-82*j*.

Figure 11:
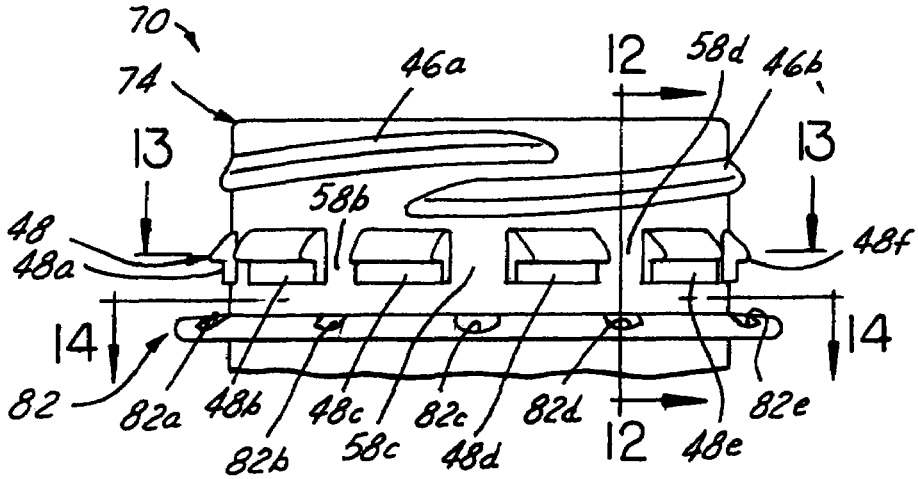
FIG. 11 is a fragmentary side elevational view of a container having a finish in accordance with another aspect of the present invention.
Figure 12:
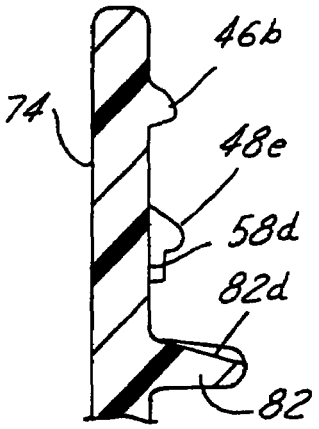
FIGS. 12, 13 and 14 are fragmentary sectional views taken substantially along the respective lines 12-12, 13-13 and 14-14 in FIG. 11.
Figure 13:
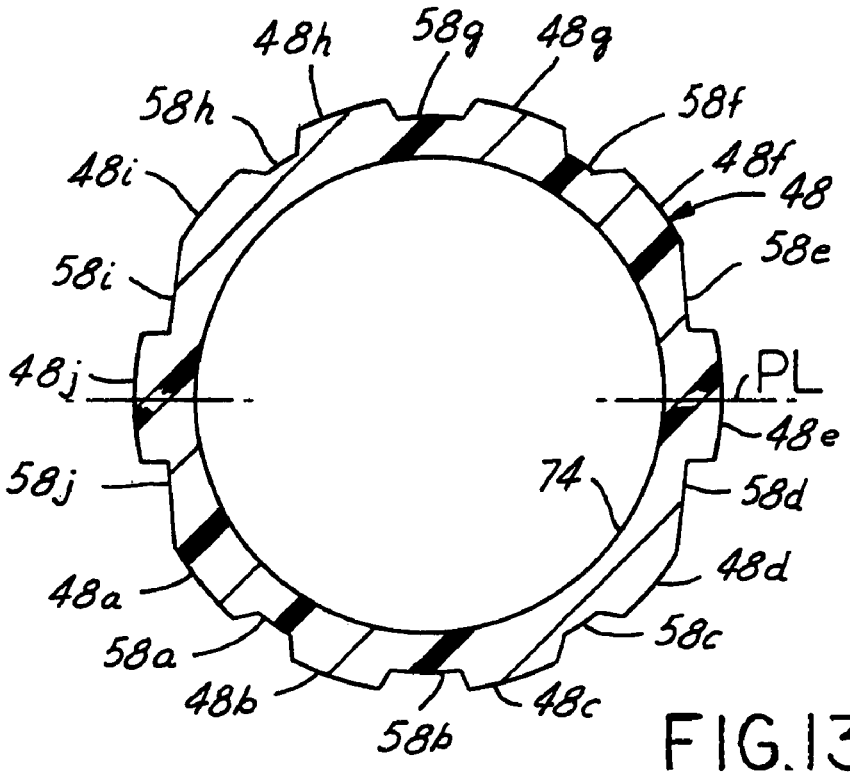
Figure 14:
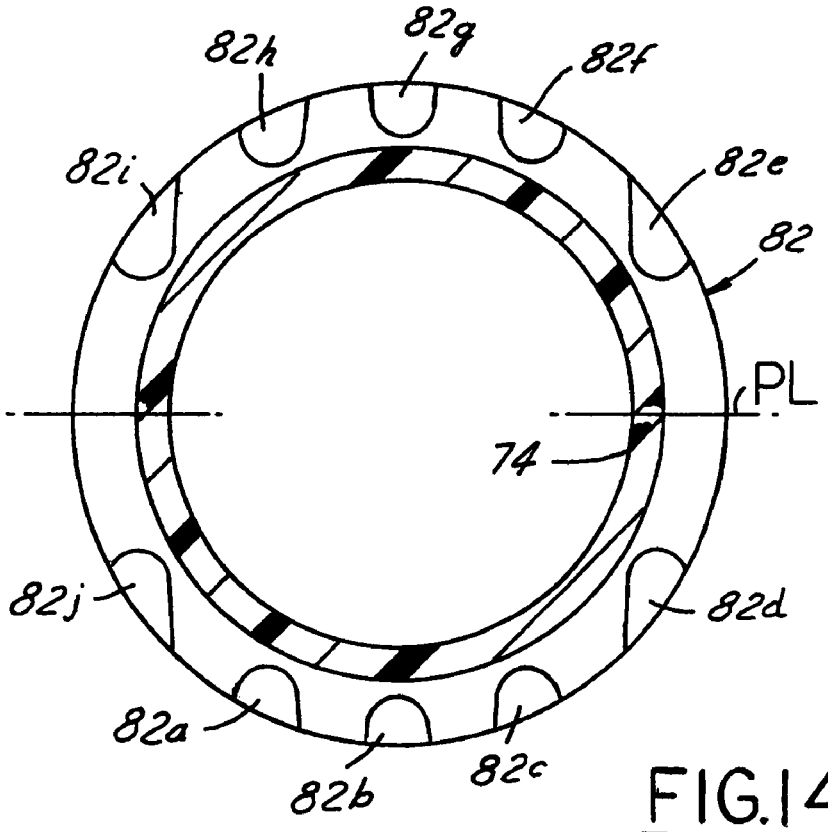
Figure 15:
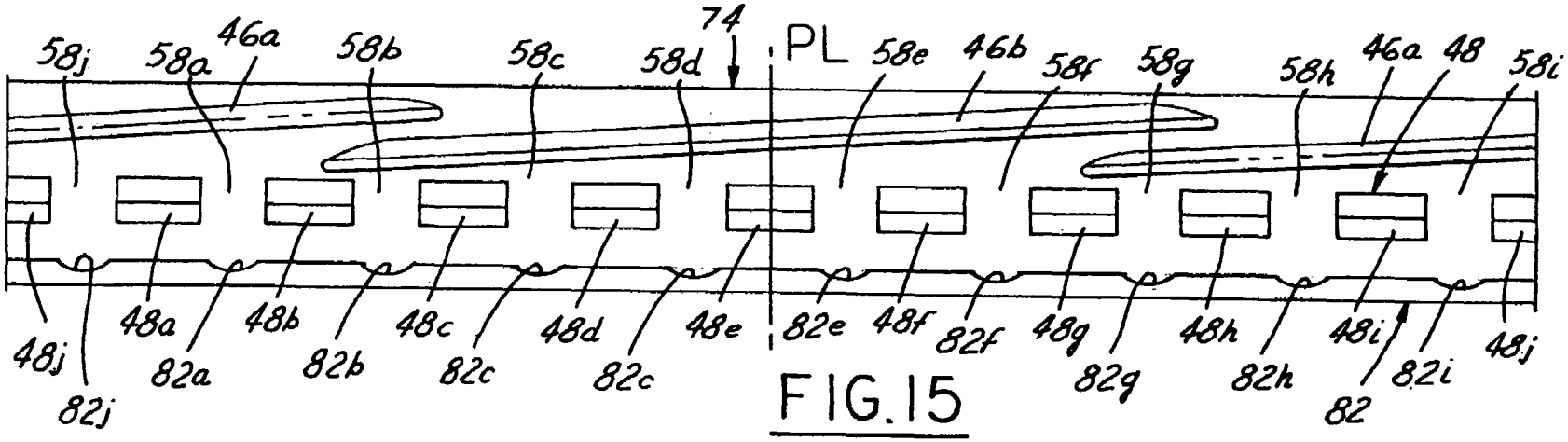
FIG. 15 is a developed elevational view of the outside surface of the container finish in FIG. 11.

The container 70 illustrated in FIGS. 11-15 (and the container in FIG. 10) is blow molded in a two-piece mold that forms a parting line PL. Bead segments 48*a*-48*j* and bead spaces 58*a*-58*j*, and slots 82*a*-82*j* in FIG. 14, are oriented at angles to parting line PL to facilitate mold separation, as best seen in FIGS. 13-14. As a design starting point, segments 48*a*-48*j* have equal tangential dimension, spaces 58*a*-58*j* have equal tangential dimension and slots 82*a*-82*j* have tangential dimensions corresponding to spaces 58*a*-58*j*. These dimensions are then varied to facilitate mold parting. By way of example for a 43 mm embodiment, segments 48*e* and 48*j* at parting line PL may have a tangential dimension of 0.378 inch, and spaces 58*b*, 58*g* at right angles to parting line PL may have tangential dimensions of 0.202 inch. All of the spaces 58*a*-58*j* extend radially from the cylindrical outer surface of the finish to the outer edges of the bead segments. Angularly of the finish axis, spaces 58*a*-58*j* have dimensions of 14.2° (spaces 58*a*, 58*c*, 58*f* and 58*h*), 15° (spaces 58*b* and 58*g*) and 17.13° (spaces 58*d*, 58*e*, 58*i* and 58*j*). Segments 48*a*-48*j* have dimensions of 28° (segments 48*e* and 48*j*), 17.5° (segments 48*a*, 48*d*, 48*f* and 48*i*), and 19.52° (segments 48*b*, 48*c*, 48*g* and 48*h*). The angular dimension of each channel or groove 82*a*-82*j* may be slightly larger than the angular dimension of the slots. The bottom surface of each groove 82*a*-82*j* has a downward angle of 5° in the illustrated embodiment. In the illustrated embodiment, grooves 82*a*-82*j* have angular dimensions of 11°20' (grooves 82*b* and 82*g*), 12°21' (grooves 82*a*, 82*c*, 82*f* and 82*h*), and 18°20' (grooves 82*d*, 82*e*, 82*i* and 82*j*).

Figure 16:
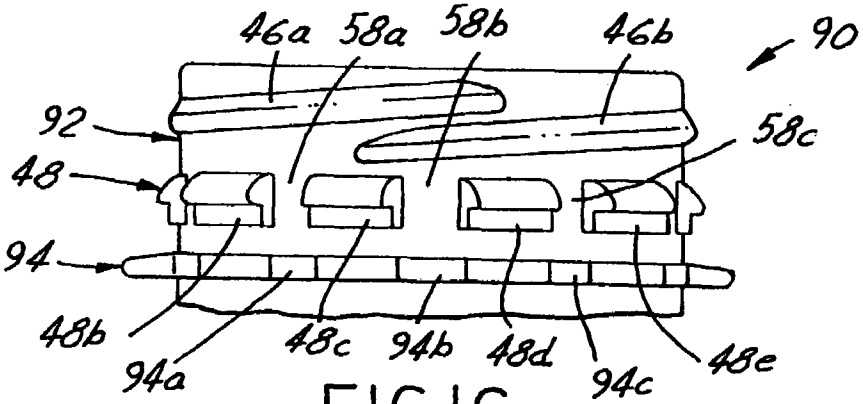
FIG. 16 is a fragmentary elevational view that illustrates a modification to the embodiment of FIG. 11.

FIG. 16 illustrates a modification 90 to the embodiment of FIGS. 11-13, in which the container finish 92 has external threads 46*a*, 46*b* and segmented bead 48 as previously described. The support flange 94 in the embodiment of FIG. 11 has circumferentially spaced spaces or gaps 94*a*, 94*b*, etc., each of which is axially aligned with a corresponding space or gap 58*a*, 58*b*, etc. in stop bead 48. As in the embodiment of FIG. 10, each gap 58*a*, 58*b*, etc. in FIGS. 11-16, and each gap 94*a*, 94*b*, etc. in FIG. 16 comprises a continuation of the cylindrical outer wall surface of the container finish.

There have thus been disclosed a closure, a container, a closure and container package, and methods of making the closure and container that fully satisfy all of the objects and aims previously set forth. A number of modifications and variations have been discussed in connection with the presently preferred embodiments of the invention. Other modifications and variations will readily suggest themselves to persons of ordinary skill in the art in view of the foregoing discussion. For example, the preferred embodiments of the closure include a stop element in the form of a flange 38. However, the stop element may comprise a radial bead, as shown in U.S. Pat. No. 4,322,009, in accordance with the broadest aspects of the invention. The invention is by no means limited to the described 43 mm embodiments of the invention, or to the exemplary dimensions disclosed in connection therewith. The invention is intended to embrace all such modifications and variations as fall within the spirit and broad scope of the appended claims.

The invention claimed is:

1. A method of making a beverage container that comprises the step of:

integrally molding a container that includes a cylindrical finish with an open mouth, at least one external thread, an external circumferential bead on a side of said thread remote from said mouth for cooperating with tamper-indicating means on a closure, and an external circumferential flange spaced from said bead on a side of said bead remote from said thread, wherein said step of molding said container is such that said bead comprises a plurality of circumferentially spaced bead segments separated from each other by circumferential gaps, said flange includes a plurality of circumferentially spaced drain elements each axially aligned with a corresponding gap in said bead, and said finish has an outer cylindrical wall surface, said external thread, said stop bead and said external support flange extending radially outwardly from said wall surface, said gaps in said bead comprising continuations of said wall surface to facilitate fluid drainage.

2. The method set forth in claim 1 wherein said drain elements comprise drain grooves in a surface of said flange axially facing said bead, each groove having a bottom surface that is angulated radially outwardly and axially away from said bead.

3. The method set forth in claim 2 wherein said drain elements comprise drain slots extending axially through said flange.

4. The method set forth in claim 2, said drain slots comprising continuations of said wall surface.

5. A method of making a package that includes:

(a) providing a container having a finish with at least one external thread and an external bead disposed beneath said thread, said external bead on said finish comprises a plurality of circumferentially spaced bead segments separated from each other by circumferential gaps, said finish having a cylindrical outer wall surface, said external thread and said external bead segments extending radially outwardly from said surface, said gaps comprising continuations of said wall surface to facilitate fluid drainage, said finish further including an external support flange beneath said bead and a plurality of circumferentially spaced drain elements on said flange, each of said drain elements being axially aligned with a corresponding gap in said bead, and (b) providing a closure that includes:

a base wall having a peripheral skirt with at least one internal thread for securing said closure to said external thread on said container finish, a tamper-indicating band frangibly connected to an edge of said skirt, a stop element on said band for abutment with said bead on said finish, a plurality of circumferentially spaced drain openings extending axially through said stop element or through said band or through both said stop element and said band, and a plurality of circumferentially spaced channels extending axially along said skirt through said internal thread, at least some of said channels being axially aligned with said drain openings.

6. The method set forth in claim 5 wherein said drain openings are uniformly circumferentially spaced around said closure, and said channels are non-uniformly circumferentially spaced around said closure.

7. The method set forth in claim 6 wherein said internal thread has a lead-in adjacent to said base wall, and wherein said channels are at lesser circumferential spacing from each other at said lead-in than spaced from said lead-in.

8. The method set forth in claim 7 wherein said at least one internal thread comprises a double thread having diametrically opposed lead-ins, and wherein said channels are at lesser spacing at said diametrically opposed lead-ins than spaced from said lead-ins.

9. The method set forth in claim 5 wherein said stop element comprises a stop flange that extends axially and radially from an end of said band, said drain openings being disposed at a juncture of said flange and said band.

10. The method set forth in claim 5 wherein said drain elements comprise drain grooves in a surface of said flange axially facing said bead, each groove having a bottom surface that is angulated radially outwardly and axially away from said bead.

11. The method set forth in claim 5 wherein said drain elements comprise drain slots extending axially through said flange.

12. The method set forth in claim 11 said drain slots through said support flange comprising continuations of said wall surface.

13. A method of making a closure and container package that includes:

(a) providing a container having a cylindrical finish with an open mouth, at least one external thread, an external circumferential bead defined by a plurality of circumferentially spaced bead segments separated from each other by circumferential gaps, an external flange spaced from said bead on a side of said bead remote from said mouth, and a plurality of circumferentially spaced drain elements on said flange each axially aligned with a corresponding gap in said bead, wherein said finish has an outer cylindrical wall surface, said external thread, said bead and said external flange extending radially outwardly from said wall surface, said gaps in said bead comprising continuations of said wall surface to facilitate fluid drainage, and (b) providing a closure that includes a base wall having a peripheral skirt with at least one internal thread for securing said closure to said external thread on said container finish, a tamper-indicating band frangibly connected to an edge of said skirt, and a stop element extending from said band for abutment with said bead.

14. The method set forth in claim 13 wherein said drain elements comprise drain grooves in a surface of said flange axially facing said bead, each groove having a bottom surface that is angulated radially outwardly and axially away from said bead.

15. The method set forth in claim 13 wherein said drain elements comprise drain slots extending axially through said flange.

16. The method set forth in claim 15 wherein said slots through said support flange comprise continuations of said wall surface.

17. The method set forth in claim 13 wherein said closure includes a first plurality of circumferentially spaced channels extending axially through said internal thread and a second plurality of circumferentially spaced drain openings extending through said stop element, at least some of said channels being axially aligned with said drain openings.

18. The method set forth in claim 17 wherein said drain openings are uniformly circumferentially spaced around said closure, and said channels are non-uniformly circumferentially spaced around said closure.

19. The method set forth in claim 18 wherein said thread has a lead-in adjacent to said base wall, and wherein said channels are at lesser circumferential spacing from each other at said lead-in than spaced from said lead-in.

20. The method set forth in claim 19 wherein said at least one internal thread comprises a double thread having diametrically opposed lead-ins, and wherein said channels are at lesser spacing from each other at said diametrically opposed lead-ins than spaced from said lead-ins.

* * * * *